US011383256B2

(12) United States Patent
Brown

(10) Patent No.: US 11,383,256 B2
(45) Date of Patent: Jul. 12, 2022

(54) POWERED WATER DISPENSER

(71) Applicant: Timothy F. Brown, Runaway Bay, TX (US)

(72) Inventor: Timothy F. Brown, Runaway Bay, TX (US)

( * ) Notice: Subject to any disclaimer, the term of this patent is extended or adjusted under 35 U.S.C. 154(b) by 22 days.

(21) Appl. No.: 16/767,068

(22) PCT Filed: Dec. 11, 2018

(86) PCT No.: PCT/US2018/064905
§ 371 (c)(1),
(2) Date: May 26, 2020

(87) PCT Pub. No.: WO2019/118429
PCT Pub. Date: Jun. 20, 2019

(65) Prior Publication Data

US 2020/0290071 A1 Sep. 17, 2020

Related U.S. Application Data

(60) Provisional application No. 62/599,033, filed on Dec. 15, 2017.

(51) Int. Cl.

| | |
|---|---|
| ***B05B 9/04*** | (2006.01) |
| ***B05B 9/043*** | (2006.01) |
| ***B05B 1/18*** | (2006.01) |
| ***B05B 9/00*** | (2006.01) |

(52) U.S. Cl.
CPC ..... *B05B 9/043* (2013.01); *B05B 1/18* (2013.01); *B05B 9/002* (2013.01)

(58) Field of Classification Search
CPC ..... B05B 9/043; B05B 1/18; B05B 9/002; A47K 3/286; A47K 3/285
See application file for complete search history.

(56) References Cited

U.S. PATENT DOCUMENTS

| | | | | |
|---|---|---|---|---|
| 3,939,503 A * | 2/1976 | Nazworth | A47K 3/286 4/616 |
| 4,688,276 A * | 8/1987 | Allison | A61H 35/02 4/620 |
| 5,111,538 A * | 5/1992 | Chapman | F24H 1/06 4/603 |
| 5,251,345 A * | 10/1993 | Pechner | A47K 3/286 4/603 |
| 6,711,758 B1 | 3/2004 | Terek et al. | |
| 7,235,176 B1 * | 6/2007 | Takagi | B05B 1/302 210/282 |

(Continued)

OTHER PUBLICATIONS

International Search Report and the Written Opinion issued in PCT/US2018/064905 dated Feb. 27, 2019, 10 pages.

*Primary Examiner* — Qingzhang Zhou
(74) *Attorney, Agent, or Firm* — Tod A. Kupstas

(57) ABSTRACT

A powered water dispenser is plugged into a vehicle or uses a rechargeable battery. The powered water dispenser is connected to a pump and a portable water source. The powered water dispenser may use a prepackaged water container that contains sterilized, distilled or potable water. Additionally, the transparent water container may use an LED light to view water level in the dark. There may also be notches that indicate water level. Also included may be a heating element to warm the water prior to use.

19 Claims, 5 Drawing Sheets

(56) References Cited

U.S. PATENT DOCUMENTS

| | | | | |
|---|---|---|---|---|
| 7,757,636 | B2 * | 7/2010 | McCallum | A01K 7/02 119/74 |
| 9,038,210 | B2 | 5/2015 | Peet | |
| 9,144,350 | B2 * | 9/2015 | Guilbeau | A47K 3/325 |
| 2003/0097710 | A1 * | 5/2003 | Adrian | F24H 1/06 4/598 |
| 2003/0106907 | A1 * | 6/2003 | Harrison | B05B 11/00444 222/383.1 |
| 2006/0255176 | A1 * | 11/2006 | Yeiser | B05B 1/083 239/263.1 |
| 2007/0089235 | A1 * | 4/2007 | Devinat | F04D 25/02 4/620 |
| 2012/0324643 | A1 * | 12/2012 | Ferry | A47K 3/286 4/597 |
| 2013/0001243 | A1 * | 1/2013 | Quick | A47K 3/285 222/333 |
| 2013/0305449 | A1 * | 11/2013 | Alios | B05B 1/18 4/615 |

* cited by examiner

POWERED WATER DISPENSER

This application claims the benefit of U.S. Provisional Application Ser. No. 62/599,033, filed Dec. 15, 2017, the contents of which are hereby incorporated herein by reference.

BACKGROUND

1. Field

Disclosed embodiments are generally related to water dispensers, in particular powered water dispensers.

2. Description of the Related Art

Access to clean, potable water is important and access to readily available water can be scarce depending on location. Interruptions of a potable water supply can occur anytime, whether the cause is flooding, burst pipes or hurricane, the effect is the same and the aftermath can be lengthy. In an emergency or in a remote location, access to water can be difficult.

Portable supplies of water exist, however existing water dispensers may need their own reservoirs. These types of devices cannot use pre-packaged water containers as the water source for their water dispensers. Instead, if someone has pre-packaged water they have to add it to an existing water container. This can result in contamination of the added water if the reservoir is not sufficiently clean.

Therefore, being able to have access to a powered water dispenser that can use and adapt pre-packaged water containers of various capacities is desired.

SUMMARY

Briefly described, aspects of the present disclosure relate to powered water dispensers.

An aspect of the present disclosure may be a powered water dispenser. The powered water dispenser may comprise a shower head housing; a shower head housed within the shower head housing; a tube having a first end and a second end, wherein the first end is operably connected to the shower head; a container adapter, wherein tube passes through the container adapter, wherein the container adapter is adapted to fit within an opening of a container; a pump housing; and a pump located within the pump housing, wherein the second end of the tube is operably connected to the pump, wherein the pump is adapted to fit within the container.

Another aspect of the present disclosure may be a method for dispensing water. The method may comprise inserting a pump housing within a pre-packaged water container, where the pump housing is part of a powered water dispenser that comprises a shower head housing; a shower head housed within the shower head housing; a tube having a first end and a second end, wherein the first end is operably connected to the shower head; a container adapter, wherein tube passes through the container adapter, wherein the container adapter is adapted to fit within an opening of a container; the pump housing; and a pump located within the pump housing, wherein the second end of the tube is operably connected to the pump; placing the container adapter on the container, securing the container adapter to the container; and operating the pump to pump a fluid within the container through the shower head.

DETAILED DESCRIPTION

Figure 1:
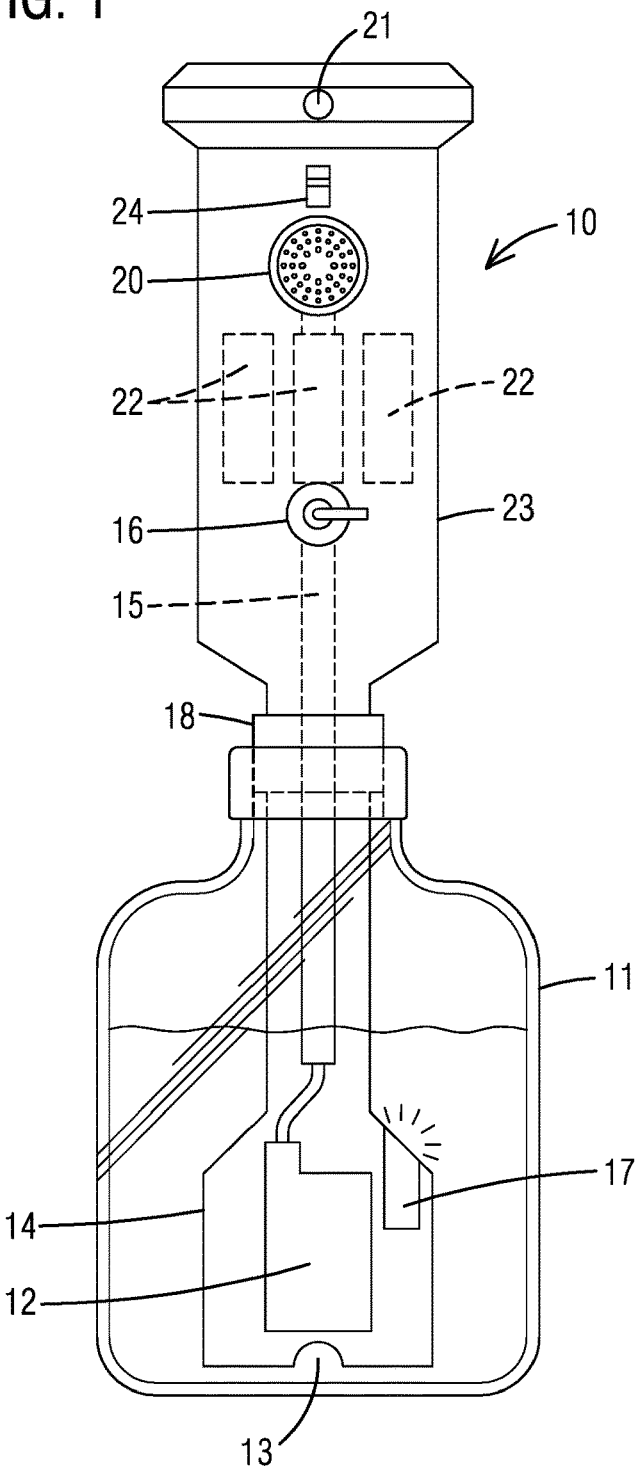
FIG. 1 shows a schematic view of the powered water dispenser.

To facilitate an understanding of embodiments, principles, and features of the present disclosure, they are disclosed hereinafter with reference to implementation in illustrative embodiments. Embodiments of the present disclosure, however, are not limited to use in the described systems or methods and may be utilized in other systems and methods as will be understood by those skilled in the art.

The components described hereinafter as making up the various embodiments are intended to be illustrative and not restrictive. Many suitable components that would perform the same or a similar function as the components described herein are intended to be embraced within the scope of embodiments of the present disclosure.

Embodiments of this disclosure can be used with various field occupations, such as first responders, municipal staff and oil field workers who do not have access to reliable water supplies. In an embodiment, the power water dispenser is used to treat people exposed to contact with chemicals or pesticides. In an embodiment, the powered water dispenser is used as an on-site emergency eye-wash and/or shower station. In an embodiment, the powered water dispenser is supplied with a larger receptacle that meets OSHA requirements. In an embodiment, the powered water dispenser is used to clean equipment in fields, for example, gauges and fittings, can be rinsed off with a portable water source. In an embodiment, the powered water dispenser is used by veterinarians and ranchers to care for livestock in the field. In an embodiment, the powered water dispenser is used by truckers and travelers to cool off or clean up as needed, without having to find a truck stop shower or motel.

In an embodiment, the powered water dispenser is used for cleaning the interior of vehicles. In an embodiment, the powered water dispenser is used for cleaning up spills in a vehicle. In an embodiment, the powered water dispenser is used for cleaning the outside of vehicles. In an embodiment, the powered water dispense is used for cleaning the windows of vehicles.

In an embodiment, the powered water dispenser is used for hosing off sand and/or debris before leaving a recreational area. In an embodiment, the powered water dispenser is used as a portable water source for food preparation and clean-up. In an embodiment, the powered water dispenser is used for showering. In an embodiment, the powered water dispenser is used to control campfires. In an embodiment, the powered water dispenser is used by sports teams for cooling stations. By having a controlled water dispenser, puddling on the field can be avoided. In an embodiment, the powered water dispenser is lighter and smaller and can be used with lighter water containers.

In an embodiment, the powered water dispenser is used by government distribution centers to distribute emergency water supplies. In an embodiment, the powered water dispenser is a personal hygiene device. In an embodiment, the powered water dispenser is used to provide drinking water. In an embodiment, the powered water dispenser is a portable personal hygiene product designed to provide access to sterilized, distilled or potable water. In an embodiment, the powered water dispenser is used by people to clean themselves under a shower of water in locations where accesses to water and/or showers are limited or unavailable.

In an embodiment, the powered water dispenser utilizes pre-packaged potable water from containers off the shelf. In other words, instead of having its own reservoir for water, a person is able to have a pre-packaged container of potable water function as the water container. This provides an advantage over devices that have their own reservoir and thus need to transfer water into the container and thus risk contamination. This further permits the powered water dispenser discussed herein to be able to function for medical purposes, such as an eye cleaner, by using sterilized water.

In an embodiment the powered water dispenser is adapted to be fitted on portable drinking containers. In an embodiment, the powered water dispenser is adapted to be fitted to gallon water containers. In an embodiment, the powered water dispenser is adapted to be fitted to water coolers. In an embodiment, the powered water dispenser is adapted to be fitted to small eye cleaning devices and containers, such as saline solution containers and eye droppers. In an embodiment, the powered water device is able to be used with barrel sized containers.

Referring now to FIG. 1, shown is an exemplary embodiment of the powered water dispenser 10. The powered water dispenser 10 comprises a pump 12, a container adapter 18 and a shower head 20. The powered water dispenser 10 has other components that are employed in its operation, however some of these components may be optional, changed or modified depending on the method in which the device is being employed.

The pump 12 is located within the pump housing 14. The pump 12 and the pump housing 14 are sized to fit within a container 11. As discussed above the container 11 may be any size. The container 11 shown is a water cooler sized container.

In an embodiment, the pump 12 and the pump housing 14 may be located outside of the container 11. In an embodiment, the pump may be located proximate to or within the shower housing 23 for the shower head 20. The pump housing 14 may have a notch 13 that enables more water to flow into the pump housing 14 so that it is moved to the shower head 20.

The shower housing 23 contains the shower head 20. Additionally, located within the shower housing 23 are batteries 22. The batteries 22 may be rechargeable. In an embodiment, the batteries are rechargeable lithium batteries. In an embodiment, the batteries are solar charged. In an embodiment, the solar charging panels for the batteries are located on the shower housing 23. In an embodiment, the batteries are kinetically rechargeable, either via a crank or via movement of the portable water dispenser 10. In an embodiment, the batteries are recharged by chemical means, for example via water fuel cells.

The powered water dispenser 10 can operate under 12V DC power. However, it should be understood that operation of the powered water dispenser 10 is not limited to the use of 12V DC power and other power sources may be used, in addition to batteries. The powered water dispenser 10 can be operated via external power sources as well. Adapter cables can be attached to vehicle power outlets and attached to receptacle located on the powered water dispenser 10. Furthermore, a cable or plug may be inserted into a standard outlet.

In an embodiment, a container adapter 18 is sized to fit securely into a standard 5-gallon water bottle. In an embodiment, the container adapter 18 is sized to fit securely onto or within a smaller container. In an embodiment, the container adapter 18 is sized to fit onto or within a larger container. The container adapter 18 may have threaded base portion that is adapted to be screwed into a container. The container adapter 18 may be sized to fit into a container in the same manner a cork is inserted into a container. In an embodiment, the container adapter 18 has a bottom portion that has a narrow diameter that gradually increases in diameter as one moves to the top of the container adapter 18. In an embodiment, the container adapter 18 is conical shaped. In an embodiment the container adapter 18 is torus shaped. In an embodiment, the container adapter 18 is adjustable and can be inflated or deflated to fill the opening of a container. In an embodiment, the container adapter 18 is twisted so that it increases in diameter as it is twisted.

In an embodiment, the container adapter 18 is a collar that is slidable on the tube 15 and helps to stabilize the shower head housing 23 when water is flowing from the shower head 20. In an embodiment, the container adapter 18 slides up and down the tube 15 to mate with the lips on the necks for containers. The openings of container may typically range between 1 and 5 centimeter opening for a 5-gallon container. However, it should be understood that the range of openings may vary. Preferably the tube 15 and the container adapter 18 are secured so that the opening is sealed and potential contamination is minimized. The friction of the container adapter 18 against the lip of the water container 11 restrains the powered water dispenser from rotating due to the force generated by the water exiting the shower head during use. In an embodiment, the tube 15 or pump housing 14 may have indicia indicated water level.

Also located on the shower housing may be a switch 24 that is operably connected to a light 21 located on the shower housing 23. The switch 24 may also be operably connected to a light 17 located on the pump housing 14. The switch 24 will operate the light 21 to provide light when using the device in low light conditions. The light 17 on the pump housing 14 is able to provide illumination within the container 11 so that the level of the water in the container 11 is visible in low light conditions. In embodiment, the lights are LED lights. In an embodiment, the lights are standard light bulbs. In an embodiment, the lights also emit illumination in other spectrums. In an embodiment, there is also an ultraviolet light emitter. In an embodiment, there is an infrared emitter. In an embodiment, there is a microwave emitter. In an embodiment, operably connected to the light is a means for sterilizing the liquid in the container 11.

Connecting the shower head 20 to the water in the container 11 is a tube 15. The tube 15 takes the water that is pumped by the pump 12 and carries it to the shower head 20. Operating the on/off switch 16 will power the pump 12 so that it can being operation and provide water through the tube 15 to the shower head 20.

The tube 15 may be 50 to 80 centimeters long. The tube 15 is preferably sized so that it fits within the neck of the container 11. The flexibility of the tube 15 may have a variety of stiffnesses. In an embodiment, the tube 15 has a stiffness similar to a garden hose. In an embodiment, the tube 15 is a metal tube. In an embodiment, the tube 15 is plastic. In an embodiment, the tube 15 is flexible. In an embodiment, the tube 15 is rigid. Furthermore, the tube 15 is adapted to be secured to the pump 14. In an embodiment, the tube 15 is telescoping. In an embodiment, the length of tube 15 is adjustable. The tube 15 may be extruded and thermally formed to provide support for the shower head 20. The upper end of the tube 15 may be threaded with a ½ inch NPT thread to allow the shower head 20 to be attached. All other components of the powered water dispenser 10 may be glued together or thermally welded where reinforcements are required, however they may be attached in other ways as well.

The shower head 20 may be an adjustable shower head 20 that is able to be extended from and retracted into the shower housing 23. The flow rate of the water may be adjusted via the shower head 20. The shower head 20 may be detachable from the shower housing 23 and the tube 15. When the shower head 20 is detached it may be replaced with an attachment, such as the eye wash attachment 41 shown in FIG. 7. Other types of attachments may be employed as well, such as a dental pick, utility hose, or other directed water source.

Figure 2:
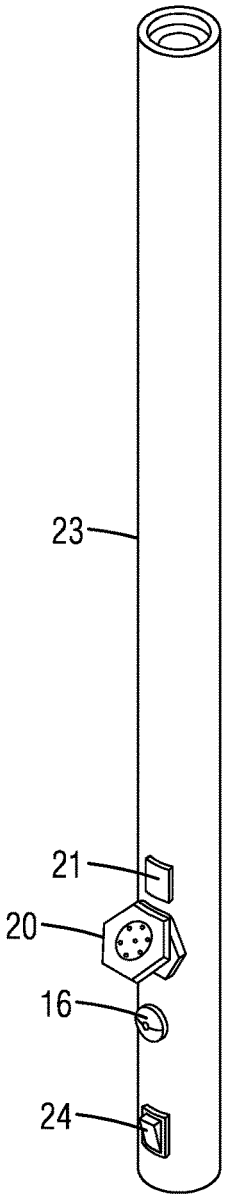
FIG. 2 shows another view of an embodiment of the water dispenser.

Turning to FIG. 2, shown is another embodiment of the shower housing 23. The shower housing 23 shown in FIG. 2 has a shower head 20 that is adjustable. Further shown in FIG. 2 is a light 21 that is located above the shower head 20. There is additionally a switch 24 and an on/off switch 16 (which may be activated by a button). The switch 24 is operably connected to light 21. The on/off switch 16 may control the power flow to the powered water dispenser 10.

Figure 3:
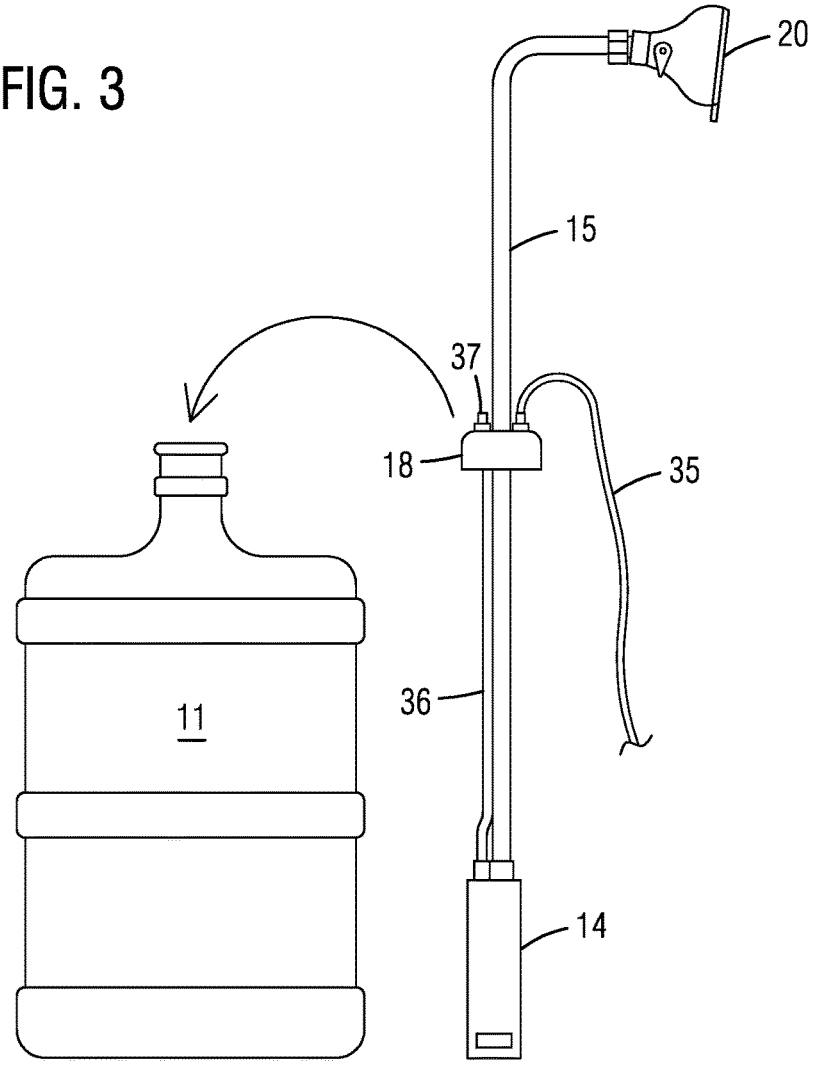
FIG. 3 shows a view of an embodiment of the powered water dispenser.

Turning to FIG. 3, shown is another view of the shower head 20 without the shower housing 23. Also shown is the pump housing 14 and tube 15 extending from the pump housing 14 to the shower head 20. Container 11 is shown next to the shower head.

In the embodiment shown in FIG. 3, an electric cord 36 is shown running the length of the tube 15. If an electric cord 36 runs the length of the tube 15, the electric cord 36 is preferably waterproof. In the embodiment shown in FIG. 2, a switch 37 may be located proximate to the container adapter 18 and further at the distal end of the electric cord 36. The container adapter 18 shown in FIG. 2 is a collar type container adapter that is adapted to be secured to the top portion of a container 11 while maintaining stability of the setup.

Additionally, an external cable 35 extends from the pump 12 and the pump housing 14, as opposed to the battery setup shown in FIG. 1. The external cable 35 may be plugged into a household outlet or capable of being plugged into a vehicle outlet.

The external cable 35 may be a 6 amp, 12V DC power plug that is found in most vehicles. Each external cable 35 may be wired with a polarizing cord interface plug and may include a protective fuse in the plug. The plug may be a service grade, hard service, thermoplastic elastomer. Both the outer and inner insulations of the external cable 35 may be oil resistant and intended for outdoor use with a sunlight and water-resistant jacket.

The external cable 35 may be for a standard vehicle DC power plug, a trailer hitch 1 (6 pin trailer connector), a trailer hitch 2 (7 blade trailer connector) and/or a OTR truck (7 pin over the road power connector). As discussed above, an alternative power source may be a molded plastic case that holds a rechargeable battery and is cylindrical in configuration. However, any shape for the battery may be used. The external cable 35 may make a connection with the pump through a waterproof switch on the collar.

Figure 4:
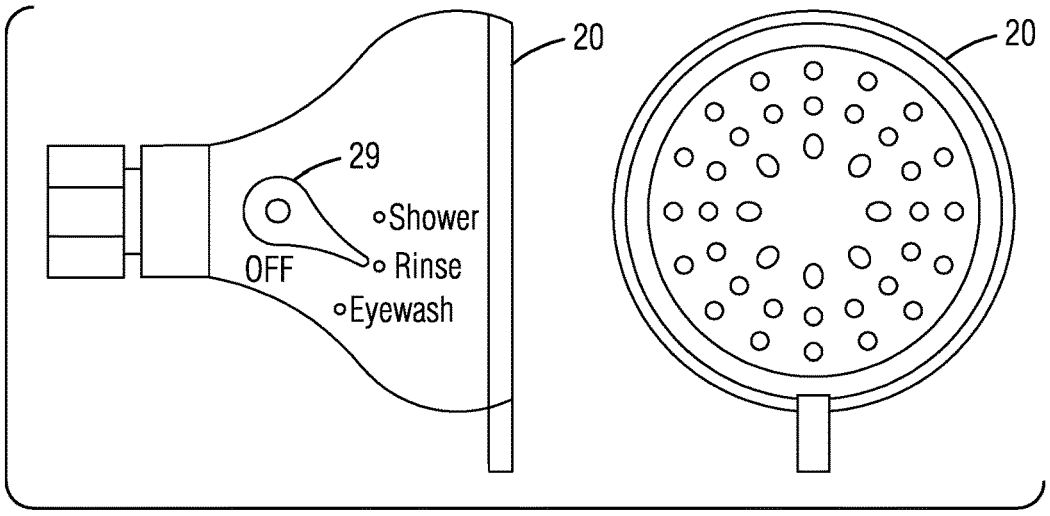
FIG. 4 shows a view of an embodiment of the shower head.

FIG. 4, shows an embodiment of the shower head 20. The shower head 20 shown has four settings that can be operated by a switch 29. The four settings are shower, rinse, eyewash and off, that can be activated by the switch 29. Each of the settings causes the water that is expelled from the shower head 20 to be expelled at different forces. The shower head 20 is adapted to be fit onto the tube 15.

The shower head 20 may be assembled from stamped stainless-steel parts and injection molded polypropylene plastic parts. The shower head 20 may be adapted to swivel using a ball and socket assembly upon which the tension can be varied. A locking ring can be used to hold a set angle in place during use. The input end of the shower head 20 may be threaded to accept a ½ inch National Pipe Thread (NPT) pipe and can use Teflon tape to insure no leaks are present. The settings are selected using a lever on the front surface of the face. A ball valve controlling the flow through the shower head 20 may be operated on the side of the shower head 20 allowing the user to shut off and turn on the shower head 20 by using a button. The shower head 20 may have an economical flow (1.5 gpm maximum).

Figure 5:
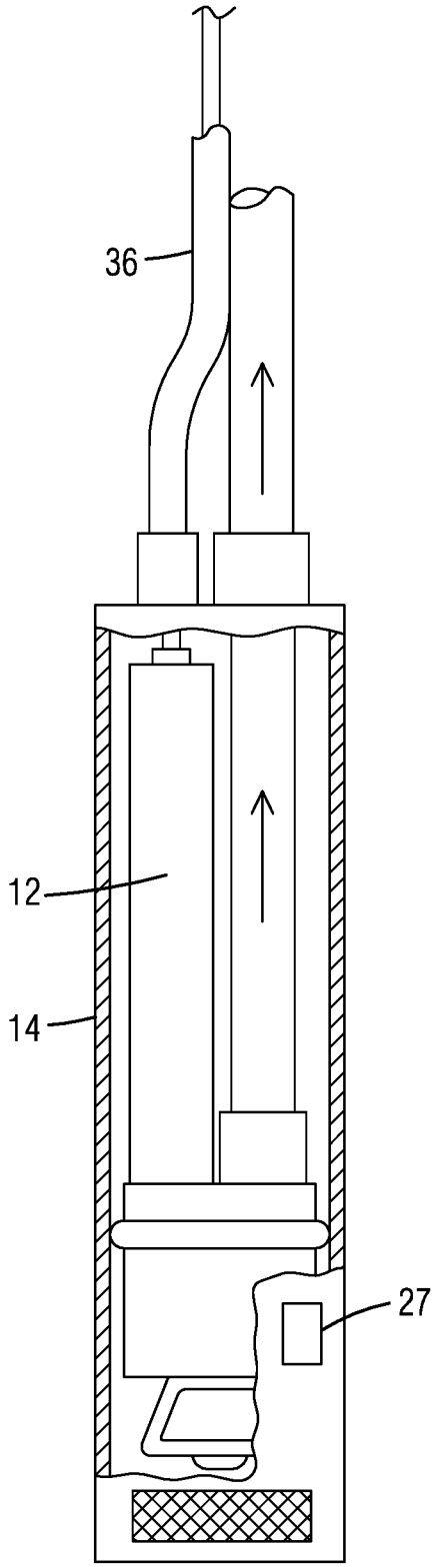
FIG. 5 shows a view of an embodiment of the pump.

FIG. 5 shows an embodiment of the pump 12 located within the pump housing 14. Pump 12 may be a 12V DC pump and may have flow rate of between 5.0 and 7.5 gallons per minute. The flow rate may vary depending on the water level in the water container. The parts of the pump 12 may be injection molded. The impeller of the pump 12 may be stainless steel that uses sealed ball bearings and vitron seals to provide a long product life. The pump 12 may have a sealed DC motor that is wired with an electric cord 36 that reaches up to the container adapter 18, where the pump 12 may be turned on or off with a waterproof switch. The output water flow may exit through the tube 15 that runs up to the shower head 20. The smooth curve of the tube 15, shown in FIG. 2, does not affect the delivered volume of water from the pump 12.

The outer diameter of the pump housing 14 should clear the inner diameter of the neck of the container 11. Preferably, the pump is of sufficient size and weight to help maintain the powered water dispenser 10 upright during use. In an embodiment, the pump housing 14 may have located thereon a heating element 27. The heating element 27 may be optional. The heating element 27 is able to heat water prior to use, so as to take a warm shower. The heating element 27 is operably connected to a power source.

The pump 12, shown in FIG. 5, may be controlled using the waterproof switch located proximate to the container adapter 18. In FIG. 1, a switch on the shower head housing 23 controls the pump 12. Referring to FIG. 2, the container adapter 18 can be adapted to slide up and down on the tube 15 to accommodate variously sized containers. A 50 to 80 centimeter length tube 15 can permit use of the powered water dispenser with almost any container that has a neck opening large enough to accommodate the diameter of the pump 12. The submersible pump 12 may be cooled by the water in which it is immersed and preferably has a flow rate larger than the requirements of the shower head 20. Preferably, the pump 12 requires no pump priming. Furthermore, cavitation is not experienced in the use of the powered water dispenser 10.

Figure 6:
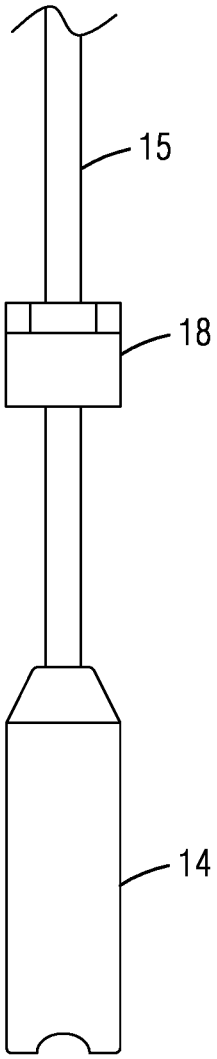
FIG. 6 shows a view of a tube and the pump.
Figure 7:
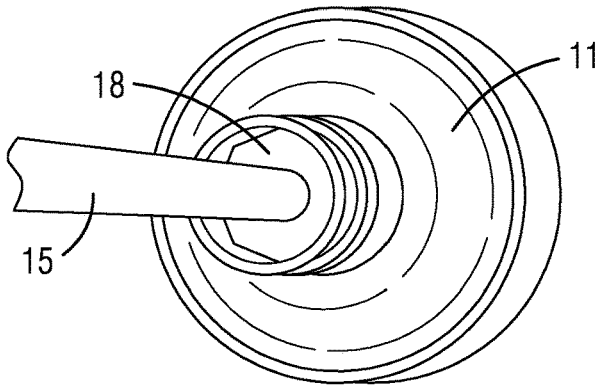
FIG. 7 is a view of a container adapter and the container.

FIG. 6 shows another view of the tube 15, container adapter 18 and the pump housing 14. In the embodiment shown in FIG. 6, the tube 15 is made of metal. FIG. 7 shows another view of the tube 15 and container adapter 18 placed with a container 11.

Figure 8:
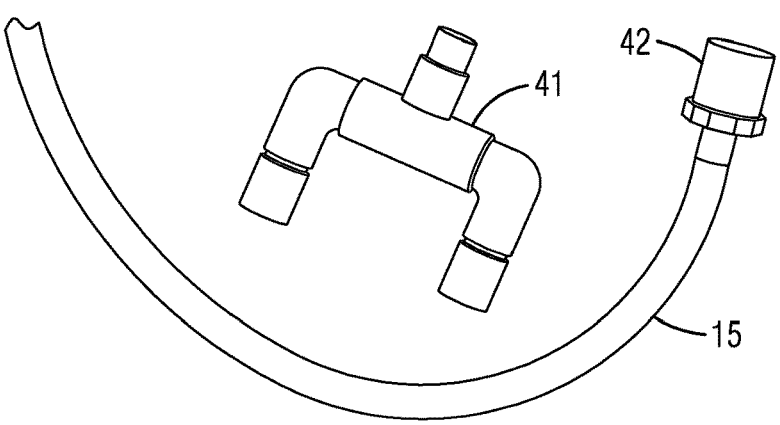
FIG. 8 is a view of an eye wash adapter.

FIG. 8 shows a view of a tube 15 and a separate eye wash adapter 41. The eye wash adapter 41 is attached to the tube 15 via a tube connector 42. The eye wash adapter 41 may provide a weaker flow of water for the purpose of cleaning eyes.

Figure 9:
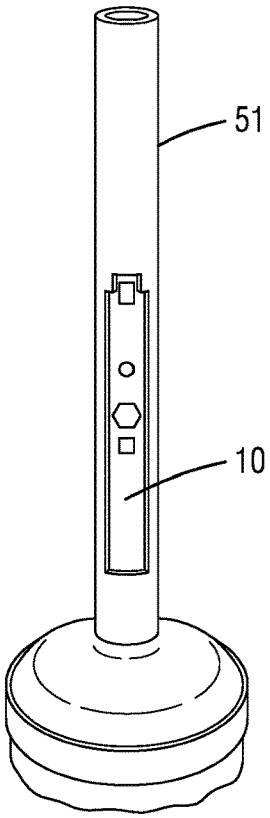
FIG. 9 is a view of the upper curtain support housing attached to the powered water dispenser.

FIG. 9 is a view of an upper portion of the powered water dispenser 10 placed within a container 11. Also shown in FIG. 9 is an optional upper curtain support housing 51. The upper curtain support housing 51 is designed to fit over the shower head housing 23 of the powered water dispenser 10 and operate with the powered water dispenser 10 so as to not interfere with the showering process. The upper curtain support housing 51 is able to support a shower curtain 53 (shown in FIG. 9) from the powered water dispenser 10. The shower curtain 53 may be stored within the upper curtain support housing 51. In an embodiment, the shower curtain 53 may be stored elsewhere and attached as needed. In an embodiment, the shower curtain 53 may be stored on the powered water dispenser 10. The shower curtain 53 may be opaque or clear. The shower curtain 53 may be made of any suitable material.

Figure 10:
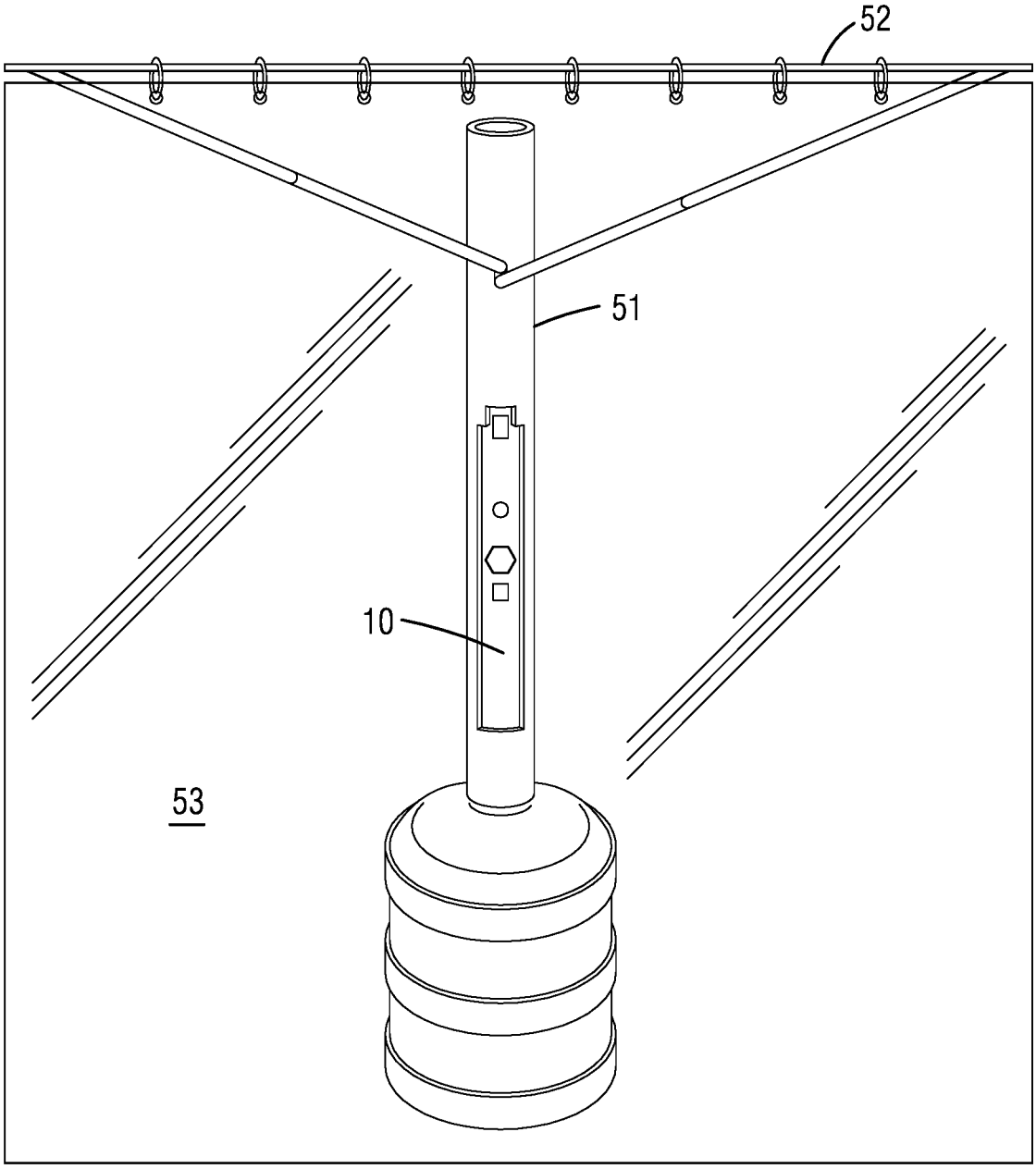
FIG. 10 is a view of the support section connected to the upper curtain support housing that is adapted to be used with the powered water dispenser.

FIG. 10 is a view of an optional support section 52 that is adapted to be used with the powered water dispenser 10, upper curtain support housing 51 and shower curtain 53. Support section 52 may be stored within a compartment within the powered water dispenser 10 or be stored separately. The support section 52 is adapted to be inserted into and retained by the upper curtain support housing 51. In the embodiment shown, the distal ends of the support section 52 are placed through the upper curtain support housing 51. In an embodiment, the distal ends of the support section 52 are secured within the interior of the upper curtain support housing 51. In an embodiment, the distal ends of the of the support section 52, as well as the remainder of the support section 52 are stored within the upper curtain support housing 51 and are taken from therein and attached together externally.

The support section 52 may be formed from a flexible easily assembled plurality of rods that are interconnected. In an embodiment, the support section 52 is formed from three rods secured together. In an embodiment, the separate rods have articulated joints when assembled, permitting flexibility. In an embodiment, the support section 52 is a unitary piece that has a plurality of articulated joints. The support section 52 may be formed from a hoop. In an embodiment, the support section 52 may be formed as a semicircle. The upper curtain support housing 51 and the support section 52 operate together in order to create shower curtain assembly. The presence of a shower curtain 53, readily accessible and able to be used with the powered water dispenser 10 allows the powered water dispenser 10 to easily be employed in hazmat situations where full body rinsing may be required. The powered water dispenser 10 is able to easily be used to dispense water within the confines of the shower curtain 52.

As mentioned elsewhere, the entire assembly of the powered water dispenser 10, upper curtain support housing 51, the support housing, the shower curtain 52 and the container 11 can be secured to a vehicle a tree or other weighty object in order to prevent the assembly from being displaced during use.

The powered water dispenser may be sized to fit securely into a container that is a standard 5-gallon water bottle. The powered water dispenser may be made of plastic to be durable. The components of the powered water dispenser may be plastic components that are molded from polyvinylchloride (PVC) plastic. The pipe sections may be extruded and the irregular sub-components may be injection molded. The PVC plastic is durable and handles water well. The PVC is chemically resistant. Any color of PVC may be used. It should be understood that while components are discussed being made with PVC other materials, such as metal, may be used.

The powered water dispenser permits a user to control water consumption for use almost anywhere the vehicle is driven or the battery pack and water container can be taken. In practice, referring to FIG. 1, the user places the pump housing 14 into the container 11. The container 11 may be a 5-gallon water bottle that has been filled with water. The powered water dispenser can also be used with, for example, with 1, 2.5, 5 gallon or larger water containers, up to exceeding 55 gallons. The powered water dispenser 10 is then connected to a power source or uses the portable batteries 23 container therein. The water is pumped and dispensed as needed.

A standard sized 5-gallon water bottle can be supplied with the powered water dispenser. Alternatively, a water container can be purchased off the shelf and used with the powered water dispenser. The water may be potable water. The water may be sterilized water. Preferably the water container is a pre-packaged sealed container to ensure that the contents of the water that is being used are sterile. When taking a pre-packaged water container and adding it to an existing reservoir there is a chance of contamination. Using the sealed container as the reservoir prevents or minimizes the potential contamination of the water.

It should be understood that while the powered water dispenser when discussed is referred to primarily as dispensing water other fluids may be dispensed from the same device. In an embodiment, the container contains a fluid other than water. In an embodiment, the powered water dispenser dispenses a pesticide from a container. In an embodiment, the powered water dispenser dispenses fertilizer from a container. In an embodiment, the powered water dispenser dispenses a flame retardant. In an embodiment, the powered water dispenser dispense a chemical solution.

A container that is clear will allow the user to see when the water container is close to being empty. Having an LED light located within the container permits one to able observe the water levels in the dark. The LED light may be integrated with the powered water dispenser or secured to the interior surface of the water container. Alternatively, the LED light may be secured to the exterior surface of the container via an attachment from the powered water dispenser.

Located on the powered water dispenser may be a strap. In an embodiment, the strap is a ratcheting strap. The strap may be attachable or detachable to powered water dispenser. The strap may be removed and used to restrain the container that is being used. This can help prevent the container from tipping over during use. The strap may be used to attach the container to a vehicle.

As discussed above, the water flow can be turned off at the head using a lever which operates an internal valve. This allows the user to leave the on-demand pump running and control the volume flowing through the head while taking the shower. The powered water dispenser may also have a light attached to the shower head. The power source used with the powered water dispenser may be a rechargeable power source. The powered water dispenser may also be broken down into its base components and stored with ease.

The means in which the shower head tube that is connected to the water container is connected may be further sealed so as to prevent contamination. Further, the powered water dispenser preferably has few or no cavities or hoses that retain moisture. In an embodiment, the materials used for the components of the powered water dispenser may be hydrophobic, thereby enhancing the prevention of water being retained in unwanted areas and forming mold. The connection to the water source may have an adjustable container adapter so that it can be fitted onto water containers with different sized openings. This can enable usage of a variety of different off the shelf water supplies. Preferably the powered water dispenser has a rechargeable power source that does not require external cords. The rechargeable power source may be charged through a car outlet or a household outlet. This avoids the use of cords during the shower process. The powered water dispenser can be hands free. The powered water dispenser head may not require the use of a hand to hold and push the button while using the shower head. The shower head may be activated and will remain activated and accessible without the use of hands. A switch may leave the shower in the on position.

The powered water dispenser may have a convenience light for the user to utilize in the dark. There may be light source built into the pump housing which aids the user to keep an eye on the water level of the water container as it is being used. Additionally, in some embodiments a heating element may be installed in the water container or configured to attach to it. The heating element may heat the contents of the water container prior to use. The heating element may be charged by the power source. The heating element may utilize a recirculating flow within or between the water container and heating element.

While embodiments of the present disclosure have been disclosed in exemplary forms, it will be apparent to those skilled in the art that many modifications, additions, and deletions can be made therein without departing from the spirit and scope of the invention and its equivalents, as set forth in the following claims.

What is claimed is:

1. A dispenser comprising:

a shower head housing;

a shower head housed within the shower head housing;

a tube having a first end and a second end, wherein the first end is operably connected to the shower head;

a container adapter, wherein the tube passes through an opening in the container adapter, wherein the container adapter is adapted to fit within an opening of a pre-packaged portable drinking water container;

a pump housing adapted to receive the tube, wherein the pump housing is placeable within the pre-packaged portable drinking water container;

a pump located within the pump housing, wherein the second end of the tube is operably connected to the pump, wherein the pump is adapted to fit within the pre-packaged portable drinking water container and pump water from the pre-packaged portable drinking water container to the shower head;

an electric cord extending from the pump through the opening in the container adapter and operably connected to a switch located on the shower head housing, wherein operation of the switch will turn the pump on and off.

2. The dispenser of claim 1, wherein the pump is operably connected to a rechargeable power source.

3. The dispenser of claim 1, wherein the pre-packaged portable drinking water container is a pre-packaged portable drinking water container containing sterilized, potable, or distilled water.

4. The dispenser of claim 1, further comprising an LED mounted on the pump housing so that the LED illuminates a level of water within the pre-packaged drinking water container when the pump housing is located within the pre-packaged drinking water container.

5. The dispenser of claim 1, wherein the pump housing further comprises a notch adapted to permit more water to flow into the pump housing from the pre-packaged portable water container.

6. The dispenser of claim 1, further comprising an upper curtain support housing adapted to support a shower curtain and a shower curtain secured to the upper curtain support housing.

7. The dispenser of claim 6, further comprising a support section inserted into the upper curtain support housing an extending horizontally with respect to the upper curtain support housing, wherein the support section secures a portion of the shower curtain.

8. The dispenser of claim 1, wherein the pump is operably connected to a vehicular power source via the electric cord.

9. The dispenser of claim 1, further comprising a ratcheting strap adapted to secure the pre-packaged portable water container when the pump housing is located within the pre-packaged portable water container.

10. A method for providing fluid comprising:

inserting a pump housing within a pre-packaged portable water container, wherein the pump housing is part of a dispenser comprising:

a shower head housing;

a shower head housed within the shower head housing;

a tube having a first end and a second end, wherein the first end is operably connected to the shower head;

a container adapter, wherein the tube passes through an opening in the container adapter, wherein the container adapter is adapted to fit within an opening of a pre-packaged portable drinking water container;

the pump housing adapted to receive the tube; and a pump located within the pump housing, wherein the second end of the tube is operably connected to the pump and adapted to pump water from the pre-packaged portable water container to the shower head;

an electric cord extending from the pump through the opening in the container adapter and operably connected to a switch located on the shower head housing, wherein operation of the switch will turn the pump on and off;

placing the container adapter on the pre-packaged portable drinking water container, securing the container adapter to the pre-packaged portable drinking water container; and operating the switch to turn on the pump to pump a fluid within the pre-packaged portable drinking water container from the pre-packaged portable drinking water container through the tube to the shower head and dispense the fluid through the shower head.

11. The method of claim 10, wherein the pump is operably connected to a rechargeable power source.

12. The method of claim 10, wherein the dispenser further comprises a ratcheting strap adapted to secure the pre-packaged portable water container when the pump housing is located within the pre-packaged portable water container.

13. The method of claim 10, wherein the dispenser further comprises an LED mounted on the pump housing so that the LED illuminates a level of water within the pre-packaged drinking water container when the pump housing is located within the pre-packaged drinking water container.

14. The method of claim 10, wherein the pump housing further comprises a notch adapted to permit more water to flow into the pump housing from the pre-packaged portable water container.

15. The method of claim 10, wherein the dispenser further comprises an LED lighting source mounted to the shower head housing.

16. The method of claim 10, further comprising detaching the shower head and attaching an eye rinse head.

17. The method of claim 10, wherein the dispenser further comprises an upper curtain support housing adapted to support a shower curtain and a shower curtain secured to the upper curtain support housing.

18. The method of claim 10, wherein the dispenser further comprises a support section inserted into the upper curtain support housing an extending horizontally with respect to the upper curtain support housing, wherein the support section secures a portion of the shower curtain.

19. A portable shower dispenser system comprising:

a pre-packaged portable drinking water container, wherein the pre-packaged portable drinking water container is adapted to contain up to five gallons of water;

a dispenser comprising:

a shower head housing;

a shower head housed within the shower head housing;

a tube having a first end and a second end, wherein the first end is operably connected to the shower head;

a container adapter, wherein the tube passes through an opening in the container adapter, wherein the container adapter is adapted to fit within an opening of a pre-packaged portable drinking water container;

a pump housing adapted to receive the tube, wherein the pump housing is placeable within the pre-packaged portable drinking water container;

a pump located within the pump housing, wherein the second end of the tube is operably connected to the pump, wherein the pump is adapted to fit within the pre-packaged portable drinking water container and pump water from the pre-packaged portable drinking water container to the shower head;

an electric cord extending from the pump through the opening in the container adapter and operably connected to a switch located on the shower head housing, wherein operation of the switch will turn the pump on and off.

* * * * *